US010460667B2

(12) United States Patent
Chen et al.

(10) Patent No.: US 10,460,667 B2
(45) Date of Patent: Oct. 29, 2019

(54) DRIVING CONTROL SYSTEM FOR DRIVING PIXEL DRIVING CIRCUIT AND DISPLAY APPARATUS THEREOF

(71) Applicant: Fitipower Integrated Technology (Shenzhen) Inc., Shenzhen (CN)

(72) Inventors: Yung-Hung Chen, Hsinchu (TW); Chang Zhu, Shenzhen (CN); Hong-Yun Wei, Shenzhen (CN)

(73) Assignee: Fitipower Integrated Technology (Shenzhen) Inc., Shenzhen (CN)

( * ) Notice: Subject to any disclaimer, the term of this patent is extended or adjusted under 35 U.S.C. 154(b) by 75 days.

(21) Appl. No.: 15/952,254

(22) Filed: Apr. 13, 2018

(65) Prior Publication Data

US 2019/0139492 A1 May 9, 2019

(30) Foreign Application Priority Data

Nov. 7, 2017 (CN) ..... 2017 1 1085396

(51) Int. Cl.
*G09G 3/3258* (2016.01)
*G09G 3/20* (2006.01)

(52) U.S. Cl.
CPC ..... *G09G 3/3258* (2013.01); *G09G 3/20* (2013.01); *G09G 2320/0233* (2013.01); *G09G 2330/02* (2013.01)

(58) Field of Classification Search
CPC ..... G09G 3/3258; G09G 3/20; G09G 2320/0233; G09G 2330/02
See application file for complete search history.

(56) References Cited

U.S. PATENT DOCUMENTS

2015/0154908 A1 6/2015 Nam et al.
2016/0196778 A1* 7/2016 Cha ..... G09G 3/20 345/694
2016/0203766 A1* 7/2016 Soni ..... G09G 3/3233 345/690

FOREIGN PATENT DOCUMENTS

CN 104700772 A 6/2015

* cited by examiner

*Primary Examiner* — Sejoon Ahn
(74) *Attorney, Agent, or Firm* — ScienBiziP, P.C.

(57) ABSTRACT

A driving control system for driving pixel driving circuits in a display apparatus includes a selecting module, a compensating circuit, and a controller. The pixel driving circuit sequentially operates during a detecting time period and a displaying period. Each pixel driving circuit comprises a driving transistor and an OLED. During the detecting time period, the selecting circuit selects at least one of the pixel driving circuits, the driving transistor in the selected at least one of the pixel driving circuits becomes saturated, the compensating circuit detects a detecting current of the selected pixel driving circuit and converts the detecting current into a specified parameter, the controller adjusts a driving voltage provided to the selected pixel driving circuit based on the specified parameter.

19 Claims, 8 Drawing Sheets

DRIVING CONTROL SYSTEM FOR DRIVING PIXEL DRIVING CIRCUIT AND DISPLAY APPARATUS THEREOF

FIELD

The subject matter herein generally relates to a driving control system for driving pixel driving circuits and a display apparatus thereof.

BACKGROUND

An active matrix organic light emitting diode (AMOLED) type display due to its higher refresh rate and its shorter response time is widely used in display apparatus. Organic light emitting diode elements are configured to emit light beams in the AMOLED type display. The AMOLED includes a plurality of pixel units and a plurality of pixel driving circuits, which correspond to the pixel units respectively. The pixel driving circuit is configured to drive the brightness of a corresponding one of the pixel units, and a control circuit is configured to control the pixel driving circuits. The pixel driving circuit includes a switching transistor, a driving transistor, and a storage capacitor. The switching transistor receives a scan signal from a corresponding scan line, and turns on for loading a data signal on a corresponding data line when the scan signal is effective, such as in a high level voltage. The storage capacitor is being charged by the loaded data signal. When the switching transistor turns off, the storage capacitor discharges and the driving transistor turns on for providing a current to the OLED, thus the OLED emits light. However, driving transistors in the pixels unit of the OLED display may be subject to manufacturing variations or operating variations. Due to such variations, transistor threshold voltages between different display pixels may vary. Variations in transistor threshold voltages can cause the pixels to produce amounts of light that do not match a desired image. A method for compensating the transistor threshold voltage can solve the above-mentioned light variation problem. In this method, a detecting time period is needed for adjusting a driving voltage provided by the pixel driving circuit, based on a threshold voltage of the driving transistor, or the current passing through the OLED before displaying period. The driving voltage adjusted based on the threshold voltage of the driving transistor is different from the driving voltage adjusted based on the current provided to the OLED. Thus, there is room for improvement in the art.

BRIEF DESCRIPTION OF THE FIGURES

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
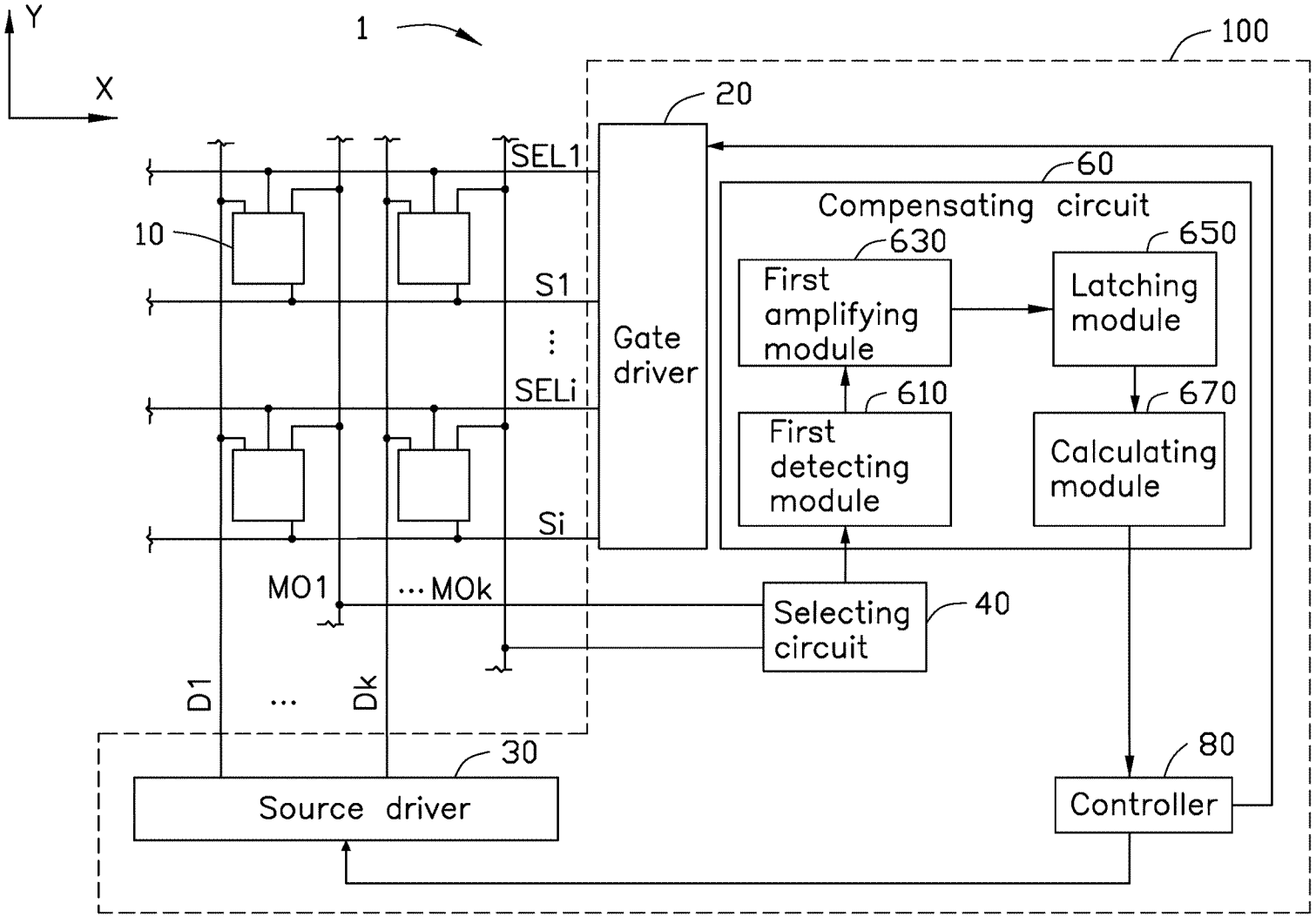
FIG. 1 is a diagrammatic view of a display apparatus, the display apparatus comprises a pixel driving circuit and a driving control system with a compensating circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "comprising," when utilized, means "including, but not necessarily limited to"; it specifically indicates open-ended inclusion or membership in the so-described combination, group, series and the like. In general, the term "module," as used herein, refers to logic embodied in hardware or firmware, or to a collection of software instructions, written in a programming language, for example, Java, C, or assembly. One or more software instructions in the modules may be embedded in firmware, such as an EPROM. It will be appreciated that modules may comprise connected logic units, such as gates and flip-flops, and may comprise programmable units, such as programmable gate arrays or processors. The modules described herein may be implemented as either software and/or hardware modules and may be stored in any type of computer-readable medium or other computer storage systems. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure is described in related to a driving control system for detecting and compensating a threshold voltage of a driving transistor and a current passing through an OLED in a pixel driving circuit of a display apparatus in one time during a detecting time period. In the embodiments, the driving control system controls the driving transistor in the pixel driving circuit to be saturated during the detecting time period for simulating a displaying period. As a result, it is possible to obtain the effect of directly compensating the threshold voltage of the driving transistor and the current of an OLED to specified value in one time.

Each pixel unit in the display apparatus is driven by signals outputted by a corresponding pixel driving circuit. The display apparatus is a current driving type active organic light emitting display apparatus. The light emitting element is an OLED. The pixel driving circuits controls brightness or light duration of the OLED.

The pixel driving circuit can include a switching transistor, a driving transistor, a resetting transistor, a storage capacitor, and an OLED. The pixel driving circuit alternately operates during a detecting time period and a displaying period. During the detecting time period, the driving transistor becomes saturated, the switching transistor and the resetting transistor turn on. The displaying period further includes a resetting period, a writing period, and an emitting period. When the scan signal is effective, such as in a high level voltage, the pixel driving circuit operates in the writing period, the switching transistor turns on. The storage capacitor charges for storing data signal on the data line. During the emitting period, the storage capacitor discharges, and a current from a power source is provided to the OLED for driving the OLED to emit light. In the embodiment, the pixel driving circuit further can operates under other periods, such as a compensating period.

The driving control system includes a gate driver for providing scan signals to the scan lines, a source driver for providing a driving voltage as the data signal to the data lines, and a controller. In the embodiment, the driving control system further includes a compensating circuit. The compensating circuit senses a detecting current of the pixel driving circuit and obtains a specified parameter, such as a time parameter. The controller adjusts a driving voltage of the source driver provided to the pixel driving circuit based on the specified parameter.

In another embodiment, the compensating circuit converts the detecting current into a pulse signal, the pulse signal alternately switches between a first level voltage and a second level voltage; the compensating circuit further calculates a sum time of the pulse signal in the first level voltage as the specified parameter.

In another embodiment, the compensating circuit converts the current in the pixel driving circuit into a detecting voltage as the specified parameter, the detecting voltage is linearly varied in accordance with time.

In another embodiment, the driving control system includes a selecting circuit. The selecting circuit selects one of the pixel driving circuits, the compensating circuit is electrically connected to the selected pixel driving circuit, the compensating circuit operates in a first sub-detecting time period and a second sub-detecting time period; during the first sub-detecting time period, the compensating circuit senses a first detecting current in the selected pixel driving circuit applied with a predetermined voltage, and converts the first detecting current into a first specified parameter; during the second sub-detecting time period, the compensating circuit senses a second detecting current in the selected pixel driving circuit applied with a pre-driving voltage, and converts the second detecting current into a second specified parameter; the controller calculates a difference between the first time parameter and the second time parameter, and compares a predetermined value and the difference, when the difference is less than the predetermined value, the controller increases the pre-driving voltage, when the difference is larger than the predetermined value, the controller decreases the pre-driving voltage, when the difference is equal to the predetermined value, the controller stores the pre-driving voltage as a driving voltage provided to the selected pixel driving circuit during the displaying period.

In another embodiment, the selecting circuit selects two adjacent pixel driving circuits, the compensating circuit is electrically connected to the two adjacent selected pixel driving circuits, one of the two adjacent selected pixel driving circuits is driven by a predetermined voltage, the other of the two adjacent selected pixel driving circuits is driven by a pre-driving voltage; the compensating circuit senses a first detecting current and a second detecting current from the two adjacent selected pixel driving circuit respectively, converts the difference between the first detecting current and the second detecting current into the pulse signal, and obtains the sum time of the pulse signal in the first level voltage as the time parameter; the controller compares a predetermined value with the time parameter; when the time parameter is less than the predetermined value, the controller increases the pre-driving voltage, when the time parameter is larger than the predetermined value, the controller decreases the pre-driving voltage, when the time parameter is equal to the predetermined value, the controller stores the pre-driving voltage as a driving voltage of the selected pixel driving circuit during the displaying period.

In an embodiment, the compensating circuit includes a first detecting module, a first amplification circuit, a latching module, and a calculating module. The first detecting module senses a detecting current in the selected pixel driving circuit selected by the selecting module and outputs a detecting voltage to the first amplified module, the first amplified module amplifies the detecting voltage in a predetermined ratio and outputs an amplified detecting voltage to the latching module, the latching module compares the amplified detecting voltage with a reference voltage and generates the pulse signal, when the amplified detecting voltage is larger than the reference voltage, the pulse signal is in a first level voltage, when the amplified detecting voltage is less than the reference voltage, the pulse signal is in a second level voltage, the calculating module calculates a sum time of the pulse signal in the first level voltage as the time parameter.

In an embodiment, the first detecting module further pre-charges the first node before sensing the first detecting current in the selected pixel driving circuit.

In another embodiment, the driving control system further includes an interface circuit. The compensating circuit and the interface circuit can be integrated in an analog-to-data converter (ADC) chip. The interface circuit establishes a transmitting path between the compensating circuit and the controller for transmitting signals. For example, the interface circuit can be a low voltage differential signaling (LVDS) interface circuit or a serial peripheral interface (SPI). The controller receives specified parameter from the compensating circuit, and outputs scan control signals for the scan lines, data driving signals for the data lines, and clock synchronization signals for the ADC chip. The compensating circuit is served as an active front end (AFE) of the ADC chip.

The detail description of the embodiment as below.

FIG. 1 illustrates an embodiment of the display apparatus 1. The display apparatus 1 includes a display panel with a plurality of pixels units 10, and a driving control system 100. The display panel can be for example a current-driving type display panel, such as an organic light emitting diode (OLED) display. The display panel includes a plurality of selecting lines SEL1-SELi, a plurality of read lines S1-Si, a plurality of data lines D1-Dk, and a plurality of monitoring lines MO1-MO*k*. In this embodiment, i and k are integers, and m is an even number. The selecting lines SEL1-SELi and the data lines D1-Dk are arranged in a grid manner to define a plurality of pixel units 10 at the crossed-line portions. The pixel units 10 are located in a display region (not labeled). FIG. 1 only shows four pixel units 10 arranged in a 2*2 matrix. The selecting lines SEL1-SELi and the read lines S1-Si are alternately parallel with each other along a first direction X. Each of the read lines S1-Si is located between two adjacent selecting lines SEL1-SELi. The data lines D1-Dk and the monitoring lines MO1-MOk are alternately parallel with each other along a second direction Y, which is perpendicular to the first direction X. Each of the monitoring lines MO1-MOk is located between two adjacent data lines D1-Dk. Each of the monitoring lines MO1-MOk is electrically connected to the pixel units 10 in one column. Each pixel unit 10 corresponds to a pixel driving circuit 110 (see FIG. 2).

The driving control system 100 includes a peripheral electronic circuit area located in a peripheral area (not labeled) around an array formed by the pixel units 10 and an external electronic circuit area without located in the display panel. The driving control system 100 includes a gate driver 20, a source driver 30, a selecting circuit 40, a compensating circuit 60, and a controller 80. In this embodiment, the gate driver 20 and the source driver 30 are located in the peripheral electronic circuit area, and the selecting circuit 40, the compensating circuit 60 and the controller 80 are located in the external electronic circuit area. Each pixel unit 10 is electrically connected to the gate driver 20 through one of the read lines S1-Si and one of the selected lines SEL1-SELi, is electrically connected to the source driver 30 through one of the data lines D1-Dk, and is further electrically connected to the selecting circuit 40 through one of the monitoring lines MO1-MOk. The selecting lines SEL1-SELi respectively apply scanning signals to the corresponding pixel units 10 for scanning the pixel units 10 in each row. The read lines S1-Si respectively apply control signals to the pixel units 10. That is, in this embodiment, the gate driver 20 is not only configured to provide the scanning signals to the selecting lines SEL1-SELi, but also regarded as a read driver to provide the control signals to the pixel units 10. Function of a read driver is embedded into the gate driver 20. The data lines D1-Dk provides driving voltages as data signals to the corresponding pixel unit 10, which indicates a luminance or a brightness of the OLED in the pixel unit 10. The controller 80 is capable of receiving a compensation signal, and outputting control signals to the gate driver 20 and the source driver 30, and clock synchronization signals. The source driver 30 generates a compensation driving voltage based on the received compensation signal in the displaying period. The driving control system 100 can further includes an interface circuit for transmitting signals between the compensating circuit 60 and the controller 80. In this embodiment, the interface circuit can be a low voltage differential signaling (LVDS) interface circuit or a serial peripheral interface (SPI). The external electronic circuit of the driving control system 100 can be integrated in an analog-to-data converter (ADC) chip.

The selecting circuit 40 selects one of the pixel driving circuits 110 as a compensation pixel driving circuit, and establishes an electrical connection between the selected pixel driving circuit 110 and the compensating circuit 60. In this embodiment, the selecting circuit 40 is a multiplexer.

Figure 2:
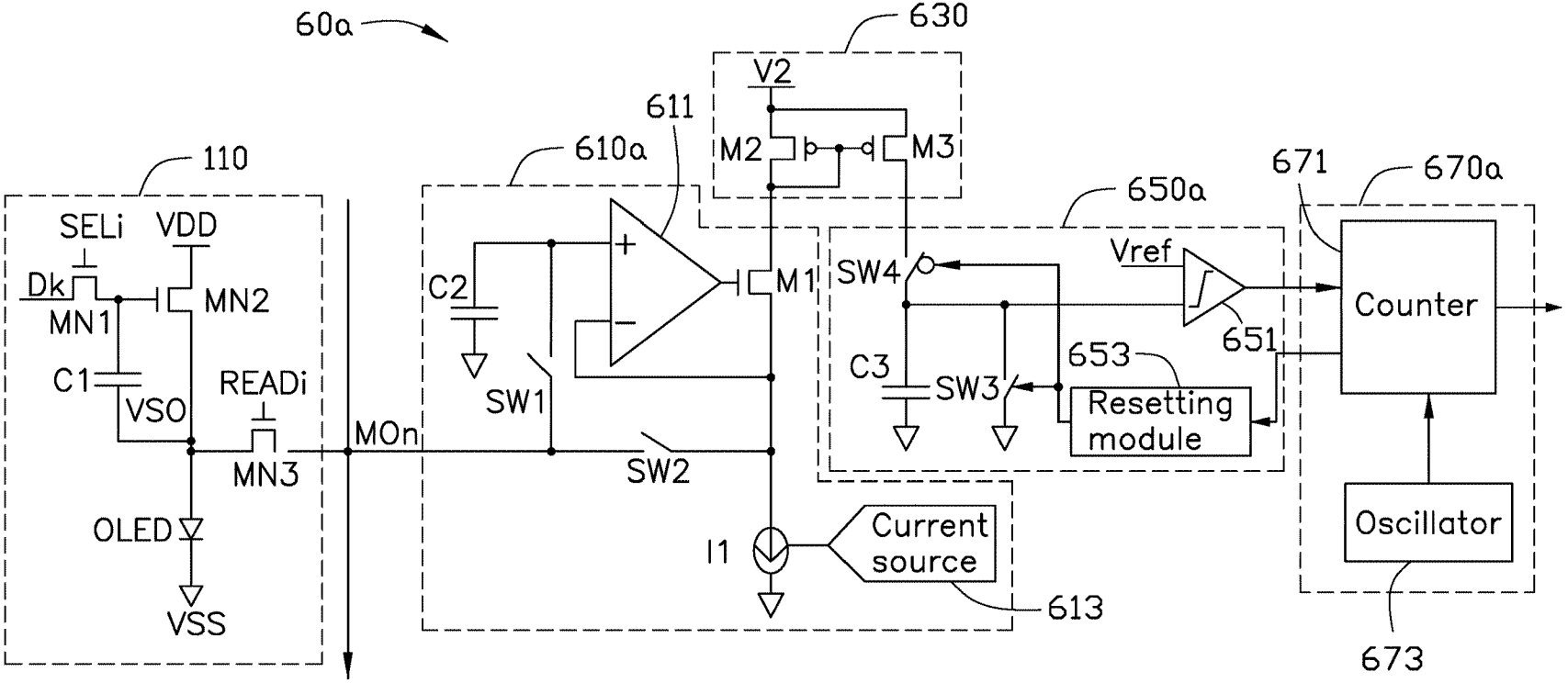
FIG. 2 is a circuit diagrammatic view of a first embodiment of the pixel driving circuit and the compensating circuit of FIG. 1, the compensating circuit comprises a first switch, a second switch, a third switch, and a fourth switch.

FIG. 2 illustrates a circuit diagrammatic view of the pixel driving circuit 110 and the compensating circuit 60*a* of the display apparatus 1 in the first embodiment. It is supposed that one of the pixel driving circuits 110 as shown in FIG. 2 is selected to be connected to the compensating circuit 60*a*, and thus the selecting circuit 40 is omitted from FIG. 2. The pixel driving circuit 110 alternately operates during a detecting time period and a displaying period. In the embodiment, the detecting time period can be an initial period of the display apparatus 1 being powered on, or a blanking time period between two adjacent display frames.

Each of the pixel driving circuits 110 includes a first power line VDD, a switching transistor MN1, a driving transistor MN2, a resetting transistor MN3, a storage capacitor C1, an OLED, and a ground terminal VSS. A leakage current and a noise current may be generate in the pixel driving circuit. In the embodiment, the switching transistor MN1, the driving transistor MN2, and the resetting transistor MN3 can be poly-silicon thin film transistors, amorphous silicon thin film transistors, or organic thin film transistors and so on.

A gate electrode of the switching transistor MN1 is electrically connected to the corresponding selecting line SELi, a drain electrode of the switching transistor MN1 is electrically connected to the corresponding data line Dk, and a source electrode of the switching transistor MN1 is electrically connected to a gate electrode of the driving transistor MN2. A drain electrode of the driving transistor MN2 is electrically connected to the first power line VDD, and a source electrode of the driving transistor MN2 is electrically connected to an anode of the OLED through a node VSO. A cathode of the OLED is electrically connected to the ground terminal VSS. A gate electrode of the resetting transistor MN3 is electrically connected to the read line Si, a source electrode of the resetting transistor MN3 is electrically connected to the node VSO, and a drain electrode of the resetting transistor MN3 is selected to be electrically connected to the compensating circuit 60*a* through a corresponding monitoring line MOn. In other words, the source electrode of the resetting transistor MN3 is electrically connected between the source electrode of the driving transistor MN2 and the anode of the OLED. A terminal of the storage capacitor C1 is electrically connected to the gate electrode of the driving transistor MN2, and the other terminal of the storage capacitor C1 is electrically connected to the source electrode of the driving transistor MN2. In the embodiment, the switching transistor MN1 is served as a switch element in the pixel driving circuit 110, the driving transistor MN2 is served as a driving element in the pixel driving circuit 110 for driving the OLED, and the resetting transistor MN3 is served as a resetting element in the pixel driving circuit 110 for resetting the potential of the storage capacitor C1.

The compensating circuit 60*a* is capable of detecting a detecting current flowing through the node VSO, converting the detecting current to a pulse signal (e.g. a rectangular wave signal or a square wave signal), and then obtaining a time parameter by counting a time of the pulse signal in a first level voltage. The compensating circuit 60*a* mainly works during the detecting time period. In the present disclosure, the detecting time period includes a first sub-detecting time period and a second sub-detecting time period. During the first sub-detecting time period, the OLED is in a non-illumination state. During the second sub-detecting time period, the OLED emits invisible light. The compensating circuit 60*a* outputs a first time parameter denoting that the current flowing through the node VSO during the first sub-detecting time period and a second time parameter denoting that the current flowing through the node VSO during the second sub-detecting time period.

In the embodiment, the compensating circuit 60*a* sequentially operates under the first sub-detecting time period and the second sub-detecting time period in turn. When the scanning signal on the selecting line SELi is effective, such as a high level voltage, and the controller 80 controls a predetermined detecting voltage being applied on the data line Dk, the compensating circuit 60*a* is in the first sub-detecting period. During the first detecting time period, the compensating circuit 60*a* senses the detecting current flowing through the node VSO in the selected pixel driving circuit 110, and generates the first time parameter based on the predetermined voltage. When the scanning signal on the selecting line SELi is effective, such as a high level voltage, and the controller 80 controls a pre-driving voltage being applied on the data line Dk, the compensating circuit 60*a* is in the second sub-detecting period. During the second sub-detecting time period, the compensating circuit 60*a* senses the detecting current flowing through the node VSO and generates the second time parameter based on the pre-driving voltage. In both of the first sub-detecting time period and the second sub-detecting time period, the driving transistor MN2 becomes saturated. During the second sub-detecting time period, the OLED emits a weak light, which is invisible to human eyes. The pre-driving voltage is larger than the predetermined detecting voltage. During the first sub-detecting time period, the detecting current may be substantially equal to a sum of a bias current Ibias, a leakage current Ileakage, and a noise current Inoise. During the second sub-detecting time period, the detecting current may be substantially equal to a sum of the bias current Ibias, the leakage current Ileakage, the noise current Inoise and a current flowing through the OLED, which is labeled by "Ioled". The value of the bias current Ibias, the leakage current Ileakage and/or the noise current Inoise cannot be varied during the detecting time period in a same environment. The compensating circuit 60*a* includes a first detecting module 610*a*, a first amplifying module 630, a latching module 650*a*, and a calculating module 670*a*.

The first detecting module 610*a* is electrically connected to the selecting circuit 40. The first detecting module 610*a* is configured to sense a detecting current of the node VSO in the selected pixel driving circuit 110, converting the detecting current into a detecting voltage, and provides the detecting voltage to the first amplifying module 630. In the embodiment, the detecting current is larger than 1 μA.

The first amplifying module 630 is electrically connected between the first detecting module 610*a* and the latching module 650*a*. The first amplifying module 630 amplifies the detecting voltage in a predetermined ratio, and outputs the amplified detecting voltage to the latching module 650*a*. In the embodiment, the predetermined ratio is 1:M, M is an integer, which is larger than 1.

The latching module 650*a* is electrically connected between the first amplifying module 630 and the calculating module 670*a*. The latching module 650*a* receives a reference voltage Vref, and generates a pulse signal based on the amplified detecting voltage and the reference voltage Vref. The pulse signal alternately switches between a first level voltage and a second level voltage. In the embodiments, the first level voltage is a high level voltage, and the second level voltage is a low level voltage. When the amplified detecting voltage is less than or equal to the reference voltage, the pulse signal is in the second level voltage, and when the amplified detecting voltage is larger than the reference voltage, the pulse signal is in first level voltage.

The calculating module 670*a* is electrically connected between the latching module 650*a* and the controller 80. The calculating module 670*a* calculates a sum time of the pulse signal in the first level voltage so as to obtain the time parameter. The calculating module 670*a* further generates a resetting signal to the latching module 650*a* for resetting. In the embodiment, the calculating module 670*a* repeats the above mentioned operations to obtain a plurality of time parameters, and considers an average time parameter as the time parameter.

The controller 80 controls the source driver 30 to generate the predetermined detecting voltage during the first sub-detecting time period, controls the source driver 30 to generate the pre-driving voltage during the second sub-detecting time period, and adjusts the pre-driving voltage based on the first time parameter and the second time parameter. The controller 80 further controls the calculating module 670*a* to generate the resetting signal. In the embodiment, the controller 80 calculates a difference between the first time parameter and the second time parameter, and compares the difference with a specified value. When the difference is less than the specified value, the controller 80 controls the source driver 30 to increase the pre-driving voltage; when the difference is larger than the specified value, the controller 80 controls the source driver 30 to decrease the pre-driving voltage. When the difference is equal to the specified value, the controller 80 stores the pre-driving voltage as data signal on the data line Dk for driving the selected pixel driving circuit 110.

The first detecting module 610*a* includes a first switch SW1, a second switch SW2, a first amplifier 611, a first capacitor C2, a first current mirror I1, a first transistor M1, and a current source 613. A positive input terminal of the first amplifier 611 is electrically connected to the drain electrode of the resetting transistor MN3 through the first switch SW1, a negative input terminal of the first amplifier 611 is electrically connected to the first current mirror I1, and an output terminal of the first amplifier 611 is electrically connected to a gate electrode of the first transistor M1. The second switch SW2 is electrically connected between the source electrode of the resetting transistor MN3 and the first current mirror I1. A terminal of the first capacitor C2 is electrically connected to the positive terminal of the first amplifier 611, and the other terminal of the first capacitor C2 is grounded. The current source 613 is electrically connected to the first current mirror I1. A drain electrode of the first transistor M1 is electrically connected to the first current mirror I1, and the source electrode of the first transistor M1 is electrically connected to the first amplifying module 630.

The first amplifying module 630 includes a second power source V2, a second transistor M2 and a third transistor M3. Gate electrodes of the second transistor M2 and the third transistor M3 are respectively electrically connected to the source electrode of the first transistor M1. Source electrodes of the second transistor M2 and the third transistor M3 are respectively electrically connected to the second power source V2. A drain electrode of the second transistor M2 is electrically connected to the source electrode of the first transistor M1. A drain electrode of the third transistor M3 is electrically connected to the latching module 650*a*.

The latching module 650*a* includes a second capacitor C3, a latch 651, a third switch SW3, a fourth switch SW4, and a resetting unit 653. A terminal of the second capacitor C3 is electrically connected to the drain electrode of the third transistor M3 through the fourth switch SW4, and the other terminal of the second capacitor C3 is grounded. A first input terminal of the latch 651 receives the first reference voltage, a second input terminal of the latch 651 is electrically connected to the drain electrode of the third transistor M3 through the fourth switch SW4, and an output terminal of the latch 651 is electrically connected to the calculating module 670. A terminal of the third switch SW3 is electrically connected between the second capacitor C3 and the fourth switch SW4, and the other terminal of the third switch SW3 is grounded. An input terminal of the resetting unit 653 is electrically connected to the calculating module 670*a*, and an output terminal of the resetting unit 653 is electrically connected to the third switch SW3 and the fourth switch SW4 for controlling the third switch SW3 and the fourth switch SW4. In the embodiment, the third switch SW3 is a P-type thin film transistor, and the fourth switch SW4 is a N-type thin film transistor.

The calculating module 670*a* includes a counter 671 and an oscillator 673. The counter 671 counts the sum time of the pulse signal in the first level voltage, and further transmits the reset signal generated by the oscillator 673 to the resetting unit 653.

Figure 3:
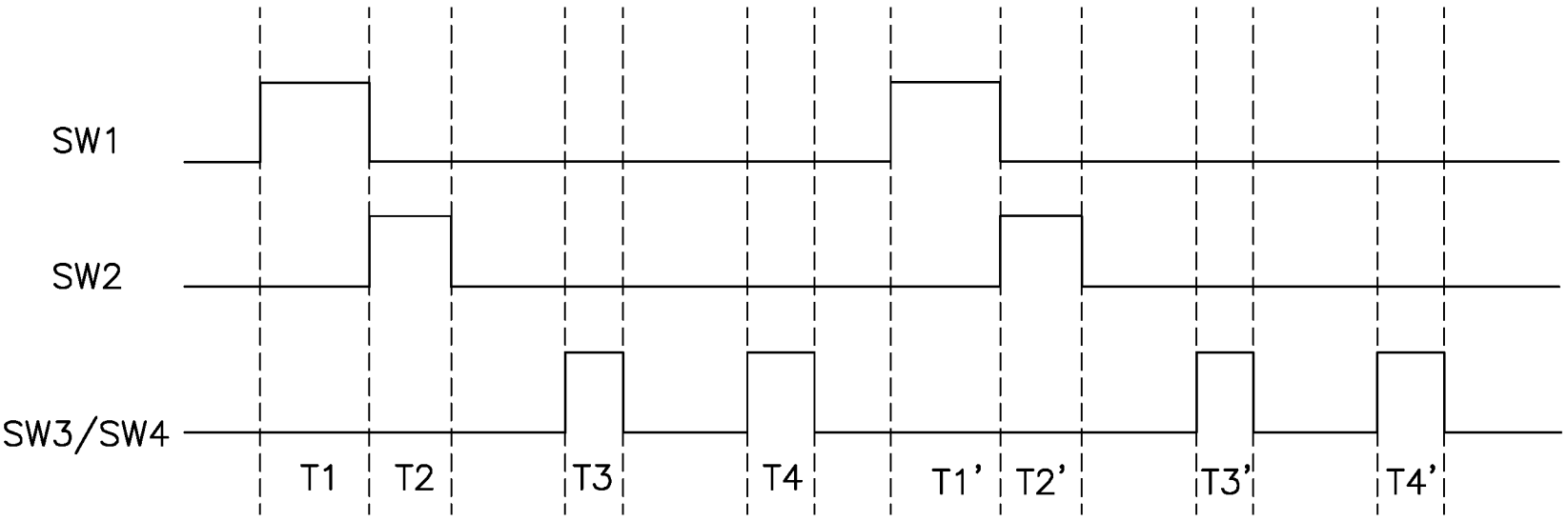
FIG. 3 is a state diagrammatic view of the first switch, the second switch, the third switch, and the fourth switch of FIG. 2.

FIG. 3 illustrates states of the first switch SW1, the second switch SW2, the third switch SW3, and the fourth switch SW4 in a different period. In the embodiment, the high level voltage indicates a turn on state, and the low level voltage indicates a turn off state. The operation of the driving control system 100 is described as below. The first sub-detecting time period includes a first period T1, a second period T2, a third period T3, and a fourth period T4, and the second sub-detecting time period includes a first period T1', a second period T2', a third period T3' and a fourth period T4'.

During the first period T1, the selecting circuit 40 selects one of the pixel driving circuit 110 for compensating, the controller 80 controls the predetermined voltage to apply to the selected pixel driving circuit 110, the switching transistor MN1 and the reset transistor MN3 turn on, and the driving transistor MN2 becomes saturated, and the OLED is disabled to emit light. The first switch SW1 turns on, the first current source 613 generates a first current to pre-charges the negative terminal of the first amplifier 611 through the first current mirror I1. The first node VSO generates the detecting current based on the predetermined voltage. The detecting current is stored by the first capacitor C2, and is provided to the positive terminal of the first amplifier 611. In the embodiment, the bias current Ibias, the leakage current Ileakage in the selected pixel driving circuit 110, and a noise current Inoise in the selected pixel driving circuit 110 are provided to the positive terminal of the first amplifier 611.

During the second period T2, the first switch SW1 turns off and the second switch SW2 turns on. The negative terminal of the first amplifier 611 receives the bias current Ibias, the leakage current Ileakage, and the noise current Inoise as the first detecting current. The first detecting current is calculated according to formula (1).

$$Isense1 = Ibias + Ileakage + Inoise \quad (1)$$

Isense1 indicates the first detecting current received by the negative terminal of the first amplifier 611 based on the predetermined voltage. Ibias indicates the first current generated by the current source 613. Ileakage indicates the leakage current generated by the OLED. Inoise indicates the noise current generated by the selected pixel driving circuit 110.

The output terminal of the first amplifier 611 outputs the detecting voltage to the first transistor M1. The detecting voltage is amplified in the predetermined ratio by the second transistor M2 and the third transistor M3, and is provided to the second capacitor C3.

During the third period T3, the third switch SW3 turns off and the fourth switch SW4 turns on, the second capacitor C3 is being charged by the amplified detecting voltage. The latch 651 compares the potential voltage of the second capacitor C3 with the reference voltage, and generates the pulse signal. When the potential of the second capacitor C3 is less than or equal to the reference voltage, the pulse signal is in the first level voltage, and when the potential of the second capacitor C3 is larger than the reference voltage, the pulse signal is in the second level voltage. The counter 671 calculates the sum time of the pulse signal in the first level voltage as the first time parameter.

During the fourth period T4, the controller 80 controls the oscillator 673 to generate the resetting signal. The third switch SW3 turns on and the fourth switch SW4 turns off based on the resetting signal, thus the second capacitor C3 discharges. In other embodiments, the controller 80 can improve a calculation precision by averaging the first time parameters of repeated calculation operation.

During the second sub-detecting time period, the controller 80 controls the source driver 30 to generate the pre-driving voltage to the data line Dk of the selected pixel driving circuit 110, and the compensating circuit 60*a* senses the current in the selected pixel driving circuit 110, and generates a second time parameter.

During the first period T1', the controller 80 controls the pre-driving voltage to apply to the selected pixel driving circuit 110, the switching transistor MN1 and the resetting transistor MN3 turn on, and the driving transistor MN2 becomes saturated, and the OLED emits a weak light. The first switch SW1 turns on, the first current source 613 generates a first current to pre-charges the negative terminal of the first amplifier 611 through the first current mirror I1. The first node VSO generates the detecting current based on the pre-driving voltage. The detecting current is stored by the first capacitor C2, and is provided to the positive terminal of the first amplifier 611. In the embodiment, the bias current Ibias, the leakage current Ileakage, the noise current Inoise, and the current flowing through the OLED Ioled are provided to the positive terminal of the first amplifier 611.

During the second period T2', the first switch SW1 turns off and the second switch SW2 turns on. The negative terminal of the first amplifier 611 receives the first current Ioled, the leakage current Ileakage, and the noise current Inoise, and the current of OLED Ioled as the second detecting current. The second detecting current is calculated according to formula (2).

$$Isense2 = Ibias + Ileakage + Inoise + Ioled \quad (2)$$

Isense2 indicates the second detecting current received by the negative terminal of the first amplifier 611 based on the pre-driving voltage. Ibias indicates the first current generated by the current source 613. Ileakage indicates the leakage current generated by the OLED. Inoise indicates the noise current generated by the selected pixel driving circuit 110. Ioled indicates the current passing through the OLED.

The output terminal of the first amplifier 611 outputs the detecting voltage to the first transistor M1. The detecting voltage is amplified in the predetermined ratio by the second transistor M2 and the third transistor M3, and is provided to the second capacitor C3.

During the third period T3', the third switch SW3 turns off and the fourth switch SW4 turns on, the second capacitor C3 is being charged by the amplified detecting voltage. The latch 651 compares the potential voltage of the second capacitor C3 with the reference voltage, and generates the pulse signal. When the potential of the second capacitor C3 is less than or equal to the reference voltage, the pulse signal is in the first level voltage, and when the potential of the second capacitor C3 is larger than the reference voltage, the pulse signal is in the second level voltage. The counter 671 calculates the sum time of the pulse signal in the first level voltage as the second time parameter.

During the fourth period T4', the controller 80 controls the oscillator 673 to generate the resetting signal. The third switch SW3 turns on and the fourth switch SW4 turns off based on the resetting signal, thus the second capacitor C3 discharges. The compensating circuit 60*a* is reset. In other embodiments, the controller 80 can improves a calculation precision by averaging the first time parameters of the repeated calculation operation.

The controller 80 further calculates the difference between the first time parameter and the second time parameter, and compares the difference with the specified value. When the value of the difference is larger than the specified value, the controller 80 controls the source driver 30 to decrease the pre-driving voltage. When the value of the difference is equal to the specified value, the controller 80 stores the pre-driving voltage as a driving voltage for driving the selected pixel driving circuit 110 in the displaying period. When the value of the difference is less than the specified value, the controller 80 controls the source driver 30 to increase the pre-driving voltage.

As described above, the compensating circuit 60*a* controls the driving transistor maintaining being saturated for simulating the operation of the pixel driving circuit 110 being in the displaying period, and generates the specified parameter (for example, the time parameter) for compensating the threshold voltage of the driving transistor and the current of the OLED in one time, thus a difference between the compensated pre-driving voltage related to the threshold voltage and the compensated pre-driving voltage related to the current of the OLED is avoided. Therefore, the display performance of the display apparatus 1 is improved.

Figure 4:
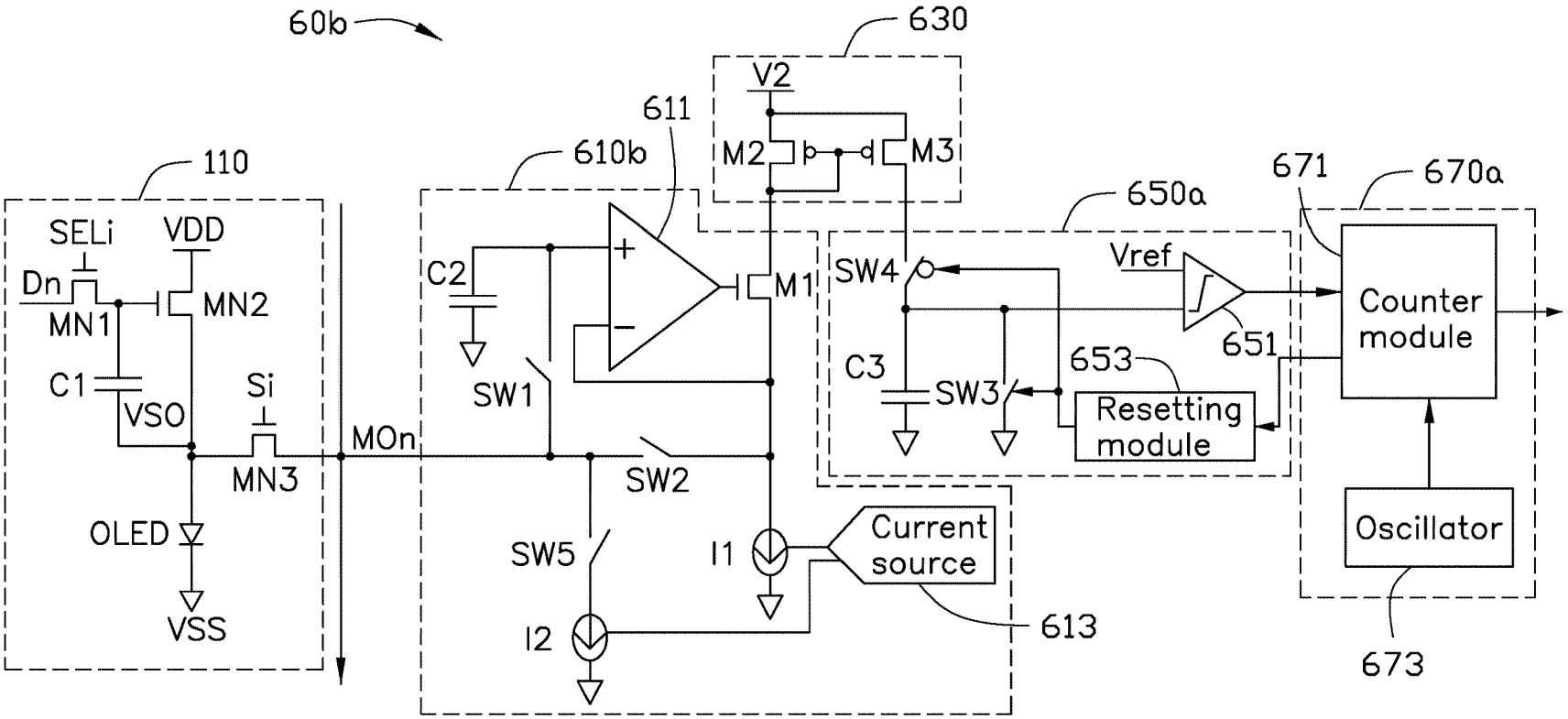
FIG. 4 is a circuit diagrammatic view of a second embodiment of the pixel driving circuit and the compensating circuit of FIG. 1.

FIG. 4 illustrates a second embodiment of a circuit diagrammatic view of the pixel driving circuit 110 and a compensating circuit 60*b*. The compensating circuit 60*b* is similar to the compensating circuit 60*a*. Elements in FIG. 4 with the same labels are the same as the elements in FIG. 2, and the electrical connections of the elements in FIG. 4 with the same labels are the same as the electrical connections of the elements in FIG. 2. The difference between the compensating circuit 60*b* and the compensating circuit 60*a* is the first detecting module 610*b*.

The first detecting module 610*b* further pre-charges the node VSO before sensing the current in the selected pixel driving circuit 110. The first detecting module 610 further includes a bypass switch SW5 and a second current mirror 12. The current source 613 further is electrically connected to the second current mirror 12. The second current mirror 12 is electrically connected to the drain electrode of the resetting transistor MN3 through the bypass switch SW5.

The operation of the compensating circuit 60*b* is different from the operation of the compensating circuit 60*a* is described as below.

In a first period T1, the selecting circuit 40 selects one of the pixel driving circuits 110 for compensating, the first switch SW1 and the bypass switch SW5 turn on, and the second switch SW2 turns off. The first current source 613 further pre-charges the node VSO through the second mirror 12, for speeding up a time of the display apparatus 1 being steadily operated. In other embodiments, when the second switch SW2 turns off, the first switch SW1 can firstly turns on before the bypass switch SW5 being turned on, or the bypass switch SW5 can firstly turns on before the bypass switch SW5 being turned on.

As described above, the compensating circuit 60*a* controls the driving transistor to be saturated for simulating the pixel driving circuit 110 in the displaying period, and generates a specified parameter for compensating the threshold voltage of the driving transistor and the current of the OLED in one time, thus a difference between the compensated pre-driving voltage related to the threshold voltage and the compensated pre-driving voltage related to the current of the OLED is avoided. Therefore, the display performance of the display apparatus 1 is improved. Further, the compensating circuit 60*b* pre-charges the node VSO for speeding up a time of the display apparatus 1 being steadily operated.

Figure 5:
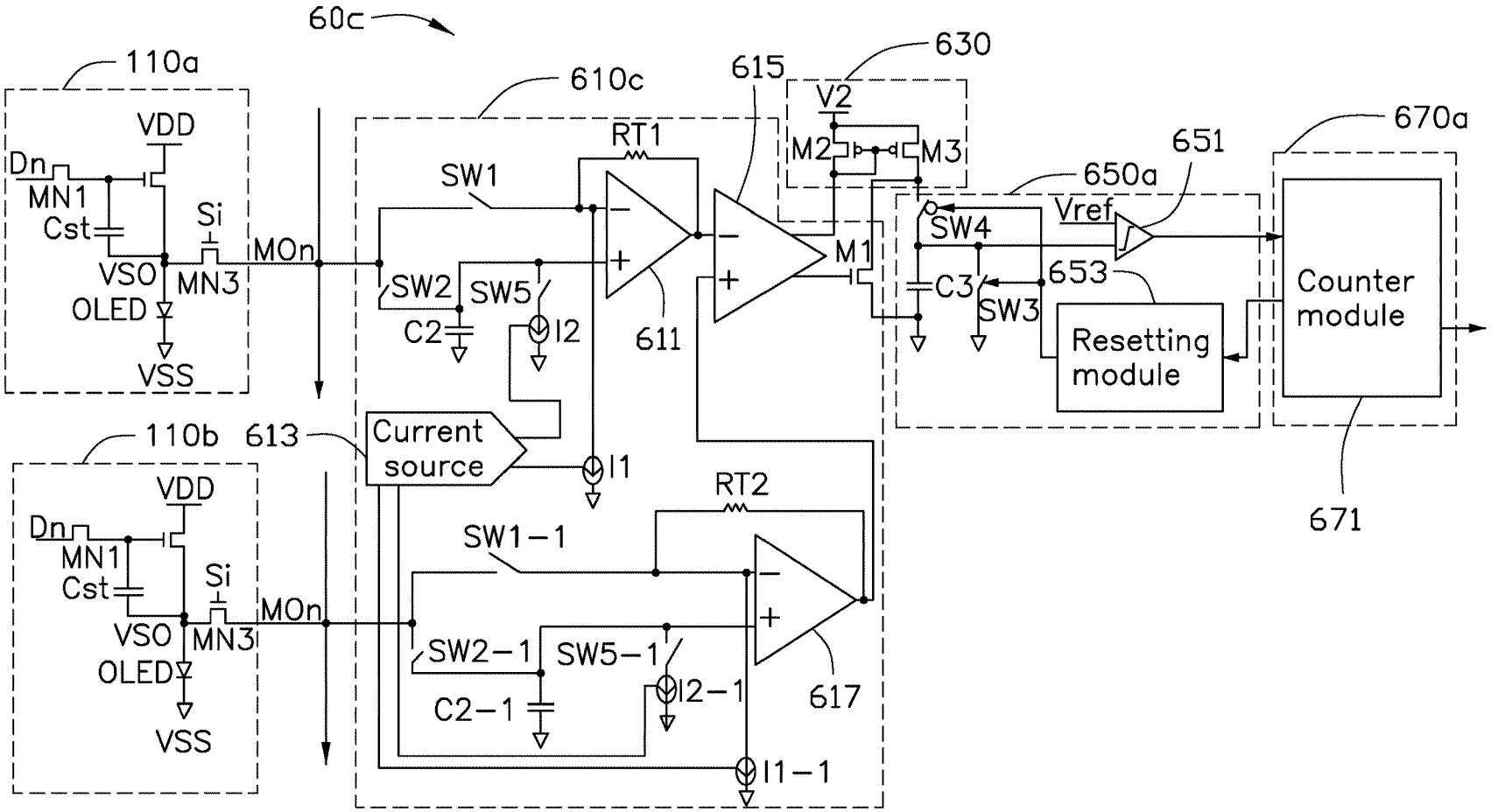
FIG. 5 is a circuit diagrammatic view of a third embodiment of the pixel driving circuits and the compensating circuit of FIG. 1.

FIG. 5 illustrates a third embodiment of a circuit diagrammatic view of two selected adjacent pixel driving circuits 110*a*-110*b* and the compensating circuit 60*c*. The compensating circuit 60*c* is similar to the compensating circuit 60*b*. Elements in FIG. 5 with the same labels are the same as the elements in FIG. 4, and the electrical connections of the elements in FIG. 5 with the same labels are the same as the electrical connections of the elements in the FIG. 4. The difference between the compensating circuit 60*c* and the compensating circuit 60*a* is the first detecting module 610*c* electrically connected two selected adjacent pixel driving circuits 110*a*-110*b*. The pixel driving circuit 110*a* is served as a to-be-compensated pixel driving circuit, and the data line Dk is applied with the pre-driving voltage. The anterior selected pixel driving circuit 110*b* is served as a comparison pixel driving circuit, and the data line D(n+1) is applied with the predetermined voltage. The compensating circuit 60*c* merely operates in the first detecting time period. FIG. 5 only shows the two selected adjacent pixel driving circuits 110*a*-110*b*. It is supposed that the two selected adjacent pixel driving circuits 110*a*-110*b* as shown in FIG. 5 are selected to be connected to the compensating circuit 60*c*, and thus the selecting circuit 40 is omitted from FIG. 5.

The first detecting module 610*c* is electrically connected to the two selected adjacent pixel driving circuits 110*a*-110*b*. The first detecting module 610*c* receives the first detecting current in the forward selected pixel driving circuits 110*a* and the second detecting current in the anterior selected pixel driving circuit 110*b*, and outputs a difference between the first detecting current and the second current to the first amplifying module 630. The first detecting module 610*c* further comprises a first sub-switch SW1-1, a second sub-switch SW2-1, a bypass sub-switch SW5-1, a first sub-capacitor C2-1, a first current sub-mirror I1-1, a second current sub-mirror 12-1, a first operational amplifier 615, a second amplifier 617, and a first resistor RT1, and a second resistor RT2. The electrical connections of the first sub-switch SW1-1, the second sub-switch SW2-1, the bypass sub-switch SW5-1, the first sub-capacitor C2-1, the first current sub-mirror I1-1, the second current sub-mirror 12-1 are the same as the electrical connections of the first switch SW1, the second switch SW2, the bypass switch SW5, the first capacitor C2, the first current mirror I1, and the second current mirror 12. The first current source 613 further is electrically connected to the first current sub-mirror I1-1 and the second current sub-mirror 12-1. Two terminals of the first resistor RT1 are electrically connected to the negative terminal and the output terminal of the first amplifier 611 respectively. Two terminals of the second resistor RT2 are electrically connected to the negative terminal and the output terminal of the second amplifier 617 respectively. In the embodiment, the first amplifier 611 and the first resistor RT1 cooperate together to form a transimpedance amplifier. The second amplifier 617 and the second resistor RT2 together to form a transimpedance amplifier. The output terminal of the first amplifier 611 is electrically connected to a negative input terminal of the first operational amplifier 615, and the output terminal of the second amplifier 617 is electrically connected to a positive input terminal of the first operational amplifier 615. A first output terminal of the first operational amplifier 615 is electrically connected to the drain electrode of the second transistor M2 and the gate electrode of the second transistor M2, and a second output terminal of the first operational amplifier 615 is electrically connected to the gate of the first transistor M1. Two terminals of the first resistor RT1 are electrically connected to the negative terminal and the output terminal of the first amplifier 611 respectively.

The operation of the compensating circuit 60*b* is different from the operation of the compensating circuit 60*a* is described as below.

During the first period T1, the selecting circuit 40 selects the two selected adjacent pixel driving circuits 110*a*-110*b*. The controller 80 controls the source driver 30 to apply the pre-driving voltage on the data line Dk in the selected pixel driving circuit 110*a* and apply the predetermined voltage on the data line D(n+1) in the anterior selected pixel driving circuit 110*b* respectively. The first switch SW1 and the first sub-switch SW1-1 turn off, the second switch SW2, the second sub-switch SW2-1, the bypass switch SW5, and the bypass sub-switch SW5-1 turn on. The nodes VSO in the two selected adjacent pixel driving circuits 110*a*-110*b* are pre-charged by the second current mirror 12 and the second current sub-mirror 12-1 respectively.

During the second period T2, the first switch SW1 and the first sub-switch SW1-1 turn on, the second switch SW2, the second sub-switch SW2-1, the bypass switch SW5, and the bypass sub-switch SW5-1 turn off. The first detecting current in the selected pixel driving circuit 110*a* is provided to the positive terminal of the first amplifier 611, and the second detecting current is provided to the positive terminal of the second amplifier 617. The first amplifier 611 converts the first detecting current Isense1 into the first detecting voltage Vsense1, and provides the first detecting voltage Vsense1 to the negative terminal of the first operational amplifier 615. The second amplifier 617 converts the second detecting current Isense2 into the second detecting voltage Vsense2, and provides the second detecting voltage Vsense2 to the positive terminal of the first operational amplifier 615. The first operational amplifier 615 outputs the difference voltage between the first detecting voltage Vsense1 and the second detecting voltage Vsense 2 to the first amplifying module 630. The first amplifying module 630 amplifies the difference voltage in the predetermined ratio, and outputs an amplified voltage to the latching module 650*a*.

During the third period T3, the third switch SW3 turns off, and the fourth switch SW4 turns on. The second capacitor C3 is being charged by the amplified difference voltage. The latch 651 compares the potential voltage of the second capacitor C3 with the reference voltage, and generates the pulse signal. When the potential of the second capacitor C3 is less than or equal to the reference voltage, the pulse signal is in the second level voltage, and when the potential of the second capacitor C3 is larger than the reference voltage, the pulse signal is in the first level voltage. The counter 671 calculates the sum time of the pulse signal in the first level voltage as the time parameter.

The controller 80 compares the time parameter with the specified value. When the time parameter is larger than the specified value, the controller 80 controls the source driver 30 to decrease the pre-driving voltage provided to the selected pixel driving circuit 110*a*. When the time parameter is equal to the specified value, the controller 80 stores the pre-driving voltage as a driving voltage for driving the selected pixel driving circuit 110*a* in the displaying period. When the time parameter is less than the specified value, the controller 80 controls the source driver 30 to increase the pre-driving voltage provided to the selected pixel driving circuit 110*a*.

During the fourth period T4, the controller 80 further controls the calculating module 670 to generate the resetting signal. The third switch SW3 turns on and the fourth switch SW4 turns off based on the resetting signal, thus the second capacitor C3 discharges. The compensating circuit 60*c* is reset.

As described above, the compensating circuit 60*c* controls the driving transistor MN2 to be saturated for simulating the pixel driving circuit 110 in the displaying period, and generates a specified parameter for compensating the threshold voltage of the driving transistor and the current of the OLED in one time, thus a difference between the compensated pre-driving voltage related to the threshold voltage and the compensated pre-driving voltage related to the current of the OLED is avoided. Therefore, the display performance of the display apparatus 1 is improved. The compensating circuit 60*c* pre-charges the node VSO for speeding up a time of the display apparatus 1 being steadily operated. Further, the compensating circuit 60*c* electrically connects with the two selected adjacent pixel driving circuit 110*a*-110*b* for sensing the first detecting current under the driving voltage and the second detecting current under the predetermined voltage in one time, a time of the detecting time period is speeded up.

Figure 6:
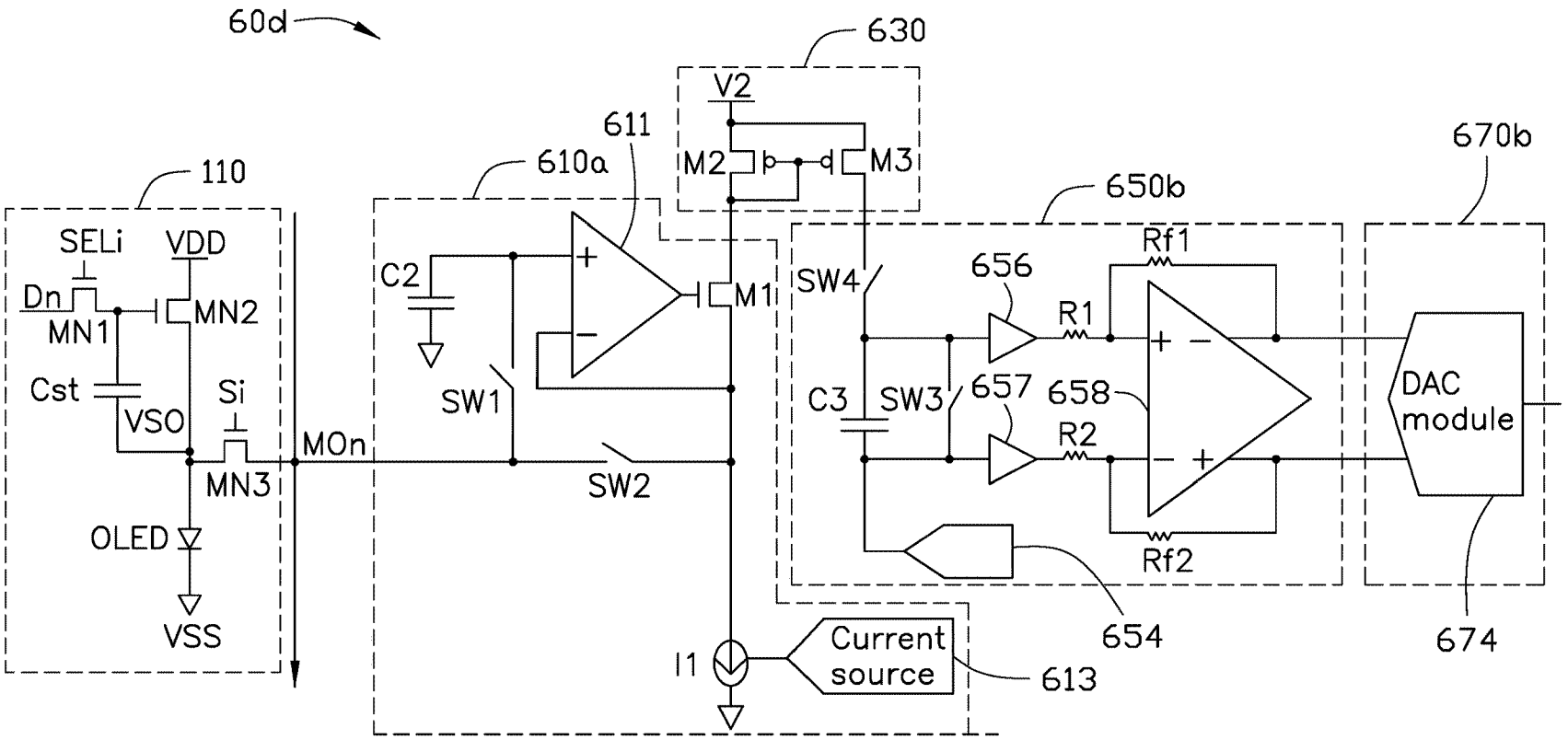
FIG. 6 is a circuit diagrammatic view of a fourth embodiment of the pixel driving circuit and the compensating circuit of FIG. 1.

FIG. 6 illustrates a fourth embodiment of a circuit diagrammatic view of the pixel driving circuit 110 and the compensating circuit 60*d*. The compensating circuit 60*d* is similar to the compensating circuit 60*c*. Elements in FIG. 6 with the same labels are the same as the elements in FIG. 2. It is supposed that the selected pixel driving circuit 110 as shown in FIG. 6 is selected to be connected to the compensating circuit 60*d*, and thus the selecting circuit 40 is omitted from FIG. 6. The difference between the compensating circuit 60*d* and the compensating circuit 60*a* is the latching module 650*b* and the calculating module 670*b*. The specified parameter of the compensating circuit 60*d* is a linear voltage, which is linearly varied in accordance with time.

The latching module 650*b* includes a third power source 654, third switch SW3, a fourth switch SW4, a second capacitor C3, a first buffer 656, a second buffer 657, an adjusting switch SWR2, a first protection resistor R1, a second protection resistor R2, a first feedback resistor Rf1, a second feedback resistor Rf2, and a second operational amplifier 658. The third power source 654 provides the reference voltage. A terminal of the second capacitor C3 is electrically connected to the drain electrode of the third transistor M3 through the fourth switch SW4, and the other terminal of the second capacitor C3 is electrically connected to the third power source 654. A positive terminal of the second operational amplifier 658 is electrically connected between the fourth switch SW4 and the second capacitor C3 through the first resistor R1 and the first buffer 656. A negative terminal of the second operational amplifier 658 is electrically connected between the third power source 654 and the second capacitor C3. A terminal of the third switch SW3 is electrically connected between the fourth switch SW4 and the second capacitor C3, and the other terminal of the third terminal is electrically connected between the third power source 654 and the second capacitor C3. A first output terminal and a second output terminal of the second operational amplifier 658 are electrically connected to the calculating module 670*b*.

The calculating module 670*b* includes a digital-to-analog conversion (DAC) unit 674. The DAC unit 674 coverts the first detecting voltage Vsense1 into a detecting voltage, which is linearly varied in accordance with time.

The operation of the compensating circuit 60*d* is different from the operation of the compensating circuit 60*a* is described as below.

During the third period T3 of the first sub-detecting time period, the third switch SW3 turns off, and the fourth switch SW4 turns off. The terminal of the second capacitor C3 is charged by the first detecting voltage Vsense1, and the potential of the terminal of the second capacitor C3 is provided to the positive terminal of the second operational amplifier 658 through the first buffer 656 and the first protection resistor R1. The first reference voltage is provided to the negative terminal of the second operational amplifier 658 through the second buffer 657 and the second protection resistor R2. The DAC unit 674 converts the amplified detecting voltage from the second operational amplifier 658 into a first linear voltage. The controller 80 obtains a first voltage at a first predetermined time and a second voltage at a second predetermined time, and calculates a first constant current based on the difference voltage between the first voltage and the second voltage and the difference between the first predetermined time and the second predetermined time.

During the fourth period T4 of the first sub-detecting time period, the fourth switch SW4 turns off, and the third switch SW3 turns on, the terminal of the second capacitor C3 discharges. Thus, the latching module 650*b* is reset.

During the third period T3' of the second sub-detecting time period, the third switch SW3 turns off, and the fourth switch SW4 turns off. The terminal of the second capacitor C3 is charged by the second detecting voltage Vsense2, and the potential of the terminal of the second capacitor C3 is provided to the positive terminal of the second operational amplifier 658 through the first buffer 656 and the first protection resistor R1. The first reference voltage is provided to the negative terminal of the second operational amplifier 658 through the second buffer 657 and the second protection resistor R2. The DAC unit 674 converts the amplified detecting voltage from the second operational amplifier 658 into a second linear voltage. The controller 80 obtains a first voltage at a first predetermined time and a second voltage at a second predetermined time, and calculates a second constant current based on the difference voltage between the first voltage and the second voltage and the difference between the first predetermined time and the second predetermined time.

During the fourth period T4' of the second sub-detecting time period, the fourth switch SW4 turns off, and the third switch SW3 turns on, the terminal of the second capacitor C3 discharges. Thus, the latching module 650*b* is reset.

The controller 80 further calculates a difference between the first constant current and the second constant current, and compares the difference with the predetermined value. When the difference is larger than the specified value, the controller 80 controls the source driver 30 to decrease the pre-driving voltage provided to the selected pixel driving circuit 110*a*. When the difference is equal to the specified value, the controller 80 stores the pre-driving voltage as a driving voltage for driving the selected pixel driving circuit 110*a* in the displaying period. When the difference is less than the specified value, the controller 80 controls the source driver 30 to increase the pre-driving voltage provided to the selected pixel driving circuit 110*a*.

As described above, the compensating circuit 60*d* controls the driving transistor to be saturated for simulating the pixel driving circuit 110 in the displaying period, and generates a specified parameter for compensating the threshold voltage of the pre-driving transistor and the current of the OLED in one time, thus a difference between the compensated pre-driving voltage related to the threshold voltage and the compensated pre-driving voltage related to the current of the OLED is avoided. Therefore, the display performance of the display apparatus 1 is improved. Further, the time of the calculating process of the compensating circuit 60*d* is decreased by the structure of the latching module 650*b* and the calculating module 670*b*.

Figure 7:
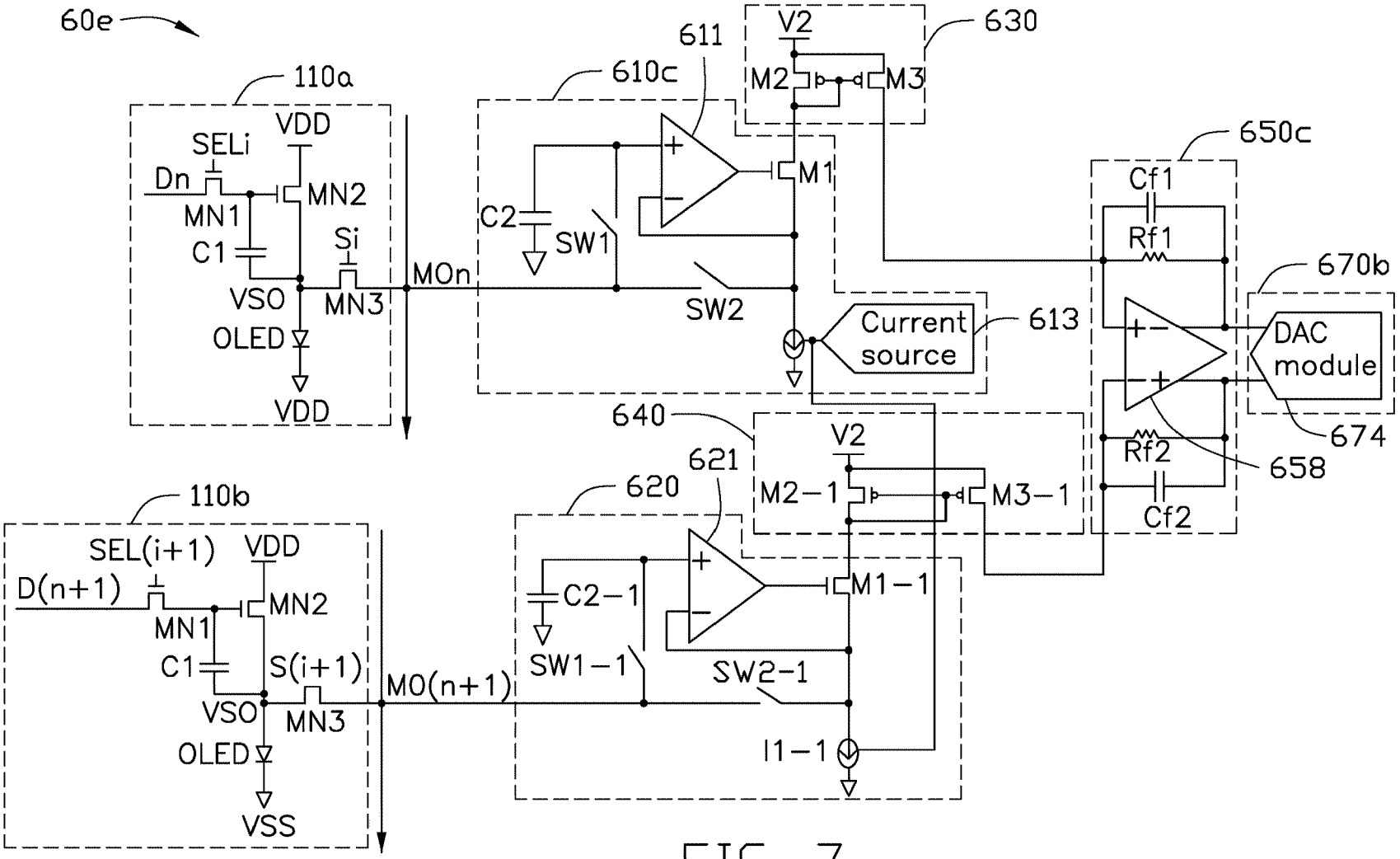
FIG. 7 is a circuit diagrammatic view of a fifth embodiment of the pixel driving circuits and the compensating circuit of FIG. 1.

FIG. 7 illustrates a fifth embodiment of a circuit diagrammatic view of the two selected adjacent pixel driving circuits 110*a*-110*b* and the compensating circuit 60*e*. The compensating circuit 60*e* is similar to the compensating circuit 60*d*. Elements in FIG. 7 with the same labels are the same as the elements in FIG. 6, and the electrical connections of the elements in FIG. 7 with the same labels are the same as the electrical connections of the elements in the FIG. 6. It is supposed that the two selected adjacent pixel driving circuits 110*a*-110*b* as shown in FIG. 7 is selected to be connected to the compensating circuit 60*e*, and thus the selecting circuit 40 is omitted from FIG. 7. In other embodiments, the pixel driving circuit 110*b* can be a dummy pixel driving circuit.

The compensating circuit 60*e* compared with the compensating circuit 60*d* further comprises a second current detecting module 620 and a second amplifying module 640. The second current detecting module 620 with the same elements in the first detecting module 610 is electrically connected to the anterior selected pixel driving circuit 110*b*.

The second current detecting module 620 includes a first sub-switch SW1-1, a second sub-switch SW2-1, a first sub-capacitor C2-1, a sub-amplifier 621, a first sub-transistor M1-1, and a first current sub-mirror I1-1. The electrical connections of the first sub-switch SW1-1, the second sub-switch SW2-1, the bypass sub-switch SW5-1, the first sub-capacitor C2-1, the first current sub-mirror I1-1, the second current sub-mirror 12-1 are the same as the electrical connections of the first switch SW1, the second switch SW2, the bypass switch SW5, the first capacitor C2, and the first current mirror I1. A positive terminal of the sub-amplifier 621 is electrically connected to the anterior selected pixel driving circuit 110*b* through the first sub-switch SW1-1. A negative terminal of the sub-amplifier 621 is electrically connected to the first current sub-mirror I1-1. An output terminal of the sub-amplifier 621 is electrically connected to a gate electrode of the first sub-transistor M1-1. The second sub-switch SW2-1 is electrically connected between the source electrode of the resetting transistor MN3 in the pixel driving circuit 110*b* and the first current sub-mirror I1-1. A terminal of the first sub-capacitor C2-1 is electrically connected to the positive terminal of the sub-amplifier 621, and the other terminal of the first sub-capacitor C2-1 is grounded. The current source 613 is further electrically connected to the first current sub-mirror I1. A drain electrode of the first sub-transistor M1-1 is electrically connected to the first current sub-mirror I1-1, and the source electrode of the first sub-transistor M1-1 is electrically connected to the second amplifying module 640.

The second amplifying module 640 with the same elements in the first amplifying module 630 is electrically connected to the negative terminal of the latching module 650c. The second amplifying module 640 includes a second sub-power source V2-1, a second sub-transistor M2-1, and a third sub-transistor M3-1. Gate electrodes of the second sub-transistor M2-1 and the third sub-transistor M3-1 are respectively electrically connected to the source electrode of the first sub-transistor M1-1. Source electrodes of the second sub-transistor M2-1 and the third sub-transistor M3-1 are respectively electrically connected to the second sub-power source V2-1. A drain electrode of the second sub-transistor M2-1 is electrically connected to the source electrode of the first sub-transistor M1-1. A drain electrode of the third sub-transistor M3-1 is electrically connected to the latching module 650c.

The latching module 650c is similar to the latching module 650b. The latching module 650c further includes a first feedback capacitor Cf1 and a second feedback capacitor Cf2. Two terminals of the first feedback capacitor Cf1 are respectively connected with the positive terminal and the first output terminal of the second operational amplifier 658. Two terminals of the second feedback capacitor Cf2 are respectively connected with the negative terminal and the second output terminal of the second operational amplifier 658.

The operation of the compensating circuit 60e is different from the operation of the compensating circuit 60b is described as below.

The selecting circuit 40 selects the two selected adjacent pixel driving circuits 110a-110b. The controller 80 controls the source driver 30 to apply the pre-driving voltage on the data line Dk in the selected pixel driving circuit 110a and apply the predetermined voltage on the data line D(n+1) in the anterior selected pixel driving circuit 110b. The first switch SW1 and the first sub-switch SW1-1 turn off, the second switch SW2 and the second sub-switch SW2-1 turn on. The first detecting voltage in the selected pixel driving circuit 110a is amplified and transmitted to the positive terminal of the second operational amplifier 658 by the first detecting module 610, and the second detecting voltage in the anterior selected pixel driving circuit 110b is amplified and transmitted to the negative terminal of the second operational amplifier 658 by the second detecting module 620 and the second amplifying module 640 as a reference voltage. The first output terminal of the second operational amplifier 658 indicates a linear voltage based on the first amplified detecting voltage from the first amplifying module 630 and the second amplified detecting voltage from the second amplifying module 640. The controller 80 obtains a first voltage at a first predetermined time and a second voltage at a second predetermined time based on the linear voltage, and calculates a constant current based on the difference voltage between the first voltage and the second voltage and the difference between the first predetermined time and the second predetermined time. The controller 80 compares the first detecting current Idetect1 with the specified value. When the constant current is larger than the specified value, the controller 80 controls the source driver 30 to decrease the pre-driving voltage provided to the selected pixel driving circuit 110a. When the constant current is equal to the specified value, the controller 80 stores the driving voltage as a pre-driving voltage for driving the selected pixel driving circuit 110a in the displaying period. When the constant current is less than the specified value, the controller 80 controls the source driver 30 to increase the pre-driving voltage provided to the selected pixel driving circuit 110a.

As described above, the compensating circuit 60e controls the driving transistor to be saturated for simulating the pixel driving circuit 110 in the displaying period, and generates a specified parameter for compensating the threshold voltage of the driving transistor and the current of the OLED in one time, thus a difference between the compensated pre-driving voltage related to the threshold voltage and the compensated pre-driving voltage related to the current of the OLED is avoided. Therefore, the display performance of the display apparatus 1 is improved. Further, the time of the calculating process of the compensating circuit 60e is decreased.

Figure 8:
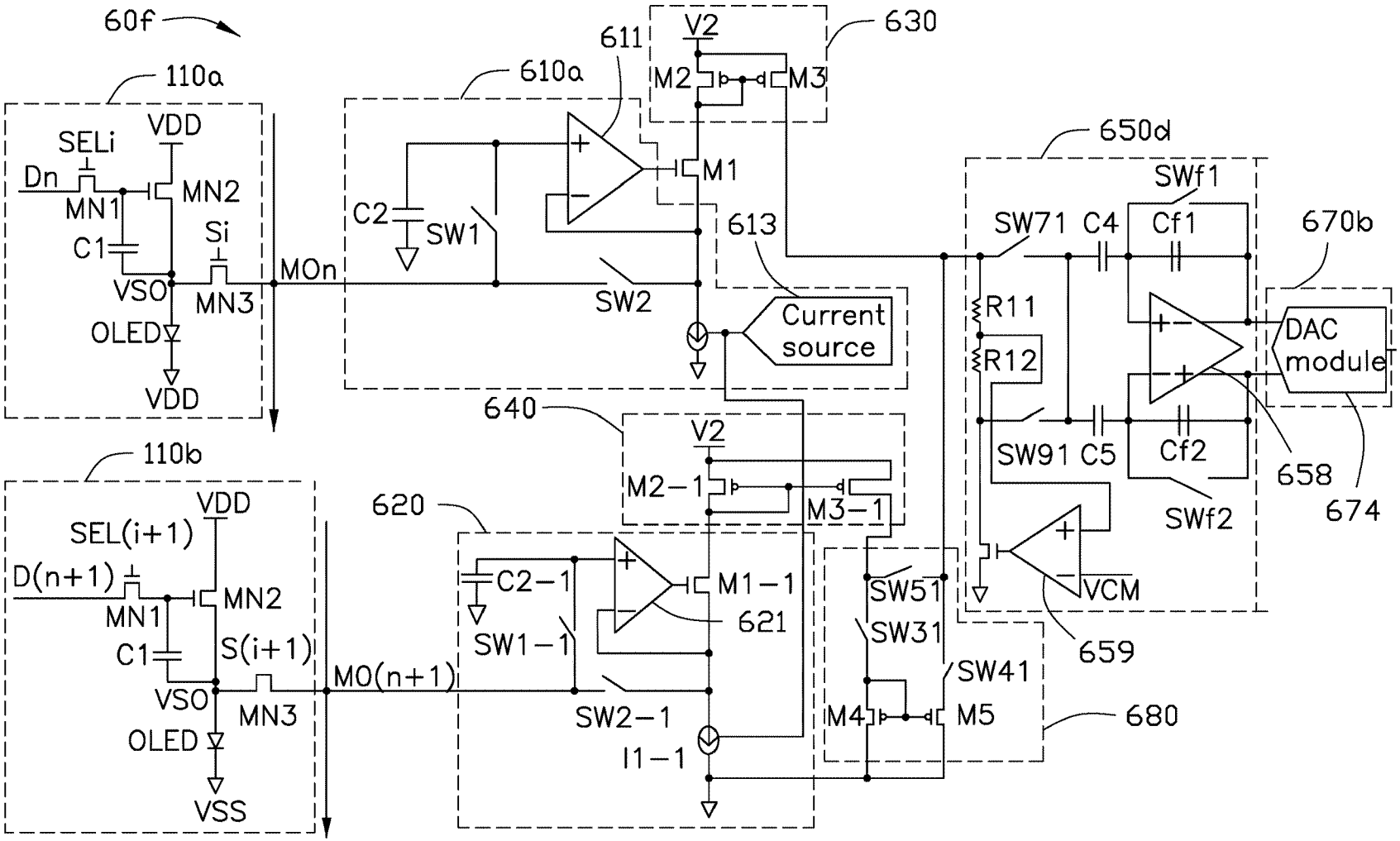
FIG. 8 is a circuit diagrammatic view of a sixth embodiment of the pixel driving circuits and the compensating circuit of FIG. 1.

FIG. 8 illustrates a sixth embodiment of a circuit diagrammatic view of the two selected adjacent pixel driving circuits 110a-110b and the compensating circuit 60f. The compensating circuit 60f is similar to the compensating circuit 60e. Elements in FIG. 8 with the same labels are the same as the elements in FIG. 7. The difference between the compensating circuit 60f and the compensating circuit 60e is the second detecting module 620 and the latching module 650d. It is supposed that the two selected adjacent pixel driving circuits 110a-110b as shown in FIG. 8 is selected to be connected to the compensating circuit 60f, and thus the selecting circuit 40 is omitted from FIG. 8. The compensating circuit 60f further includes a control module 680. The first detecting module 610 is electrically connected to the selected pixel driving circuit 110a. The second current detecting module 620 with the same elements in the first detecting module 610 is electrically connected to the anterior selected pixel driving circuit 110b. The control module 680 controls a difference current between the first detecting current Isense1 and the second detecting current Isense2 to being applied to the latching module 650d.

The first detecting module 610 is electrically connected between the selected pixel driving circuit 110a and the control module 680. The second detecting module 620 with the same elements in the first detecting module 610 is electrically connected between the anterior selected pixel driving circuit 110b and the control module 680. The control module 680 is further electrically connected to the latching module 650d.

The control module 680 includes a first controlling switch SW31, a second controlling switch SW41, a controlling switch SW51, a first control transistor M4, and a second control transistor M5. Gate electrodes of the first control transistor M4 and the second control transistor M5 are electrically connected together, and are further electrically connected to a source electrode of the first control transistor M4. The source electrode of the first control transistor M4 is electrically connected to the drain electrode of the third sub-transistor M3-1 through the first controlling switch SW31, a drain electrode of the first control transistor M4 is grounded. A source electrode of the second control transistor M5 is electrically connected to a drain electrode of the third sub-transistor M3-1 through the second controlling switch SW41 and the third controlling switch SW51, and is further electrically connected to the drain electrode of the third transistor M3 through the second controlling switch SW41. A drain electrode of the second control transistor M5 is grounded.

The latching module 650d further includes a first divider resistor R11, a second divider resistor R12, a fourth transistor M6, a third amplifier 659, a third capacitor C4, a fourth capacitor C5, a fourth controlling switch SW71, a fifth controlling switch SW81, a sixth controlling switch SW91, a first resetting switch SWF1, and a second resetting switch SWF2. A source electrode of the fourth transistor M6 is electrically connected to the drain electrode of the third transistor M3 through the first divider resistor R11 and the second divider resistor R12. A gate electrode of the fourth transistor M6 is electrically connected to an output terminal of the third amplifier 659. A drain electrode of the fourth transistor M6 is grounded. A positive terminal of the third amplifier 659 is electrically connected between the first divider resistor R11 and the second divider resistor R12. A negative terminal of the third amplifier 659 receives the reference voltage VCM. The fourth controlling switch SW71 and the third capacitor C4 are electrically connected between the drain electrode of the third transistor M3 and the positive terminal of the third amplifier 659 in series. The sixth controlling switch SW91 and the fourth capacitor C5 are electrically connected between the source electrode of the fourth transistor M6 and the negative terminal of the third amplifier 659 in series. A terminal of the fifth controlling switch SW81 is electrically connected between the fourth controlling switch SW71 and the third capacitor C4, and the other terminal of the fifth controlling switch SW81 is electrically connected between the sixth controlling switch SW91 and the fourth capacitor C5. Two terminals of the first resetting switch SWF1 are respectively electrically connected to the positive terminal and the first output terminal of the second amplifier 658. Two terminals of the second resetting switch SWF2 are respectively electrically connected to the negative terminal and the second output terminal of the second amplifier 658. The first resetting switch SWF1 resets the positive terminal of the second amplifier 658, and the second switch SWF2 resets the second output terminal of the second amplifier 658.

The operation of the compensating circuit 60*f* is different from the operation of the compensating circuit 60*e* is described as below.

During the third period T3 of the first detecting time period, the first controlling switch SW31 and the second controlling switch SW41 turn on, and the third controlling switch SW51 turns off. The first detecting current Isense1 is provided to source electrode of the first control transistor M4 and gate electrodes of the first control transistor M4 and the second transistor M5. The second detecting current Isense2 is provided to the source electrode of the second control transistor M5. Based on the first control transistor M4 and the second control transistor M5, the difference current of the first detecting current Isense1 and the second detecting current Isenses2 is provided to the negative terminal of the second amplifier 658 through the first divider resistor R11 and the second divider resistor R12, is further provided to the positive terminal of the third amplifier 659 through the first divider resistor R11, and is also provided to the positive terminal of the second amplifier 658. The third amplifier 659 clamps the voltage between the first divider resistor R11 and the second divider resistor R12 at the first reference voltage. The first output terminal of the second operational amplifier 658 indicates a linear voltage. The controller 80 obtains a first voltage at a first predetermined time and a second voltage at a second predetermined time based on the linear voltage, and calculates a constant current based on the difference voltage between the first detecting voltage and the second detecting voltage and the difference between the first predetermined time and the second predetermined time. The controller 80 compares the constant current with the specified value. When the constant current is larger than the specified value, the controller 80 controls the source driver 30 to decrease the pre-driving voltage provided to the selected pixel driving circuit 110*a*. When the constant current is equal to the specified value, the controller 80 stores the pre-driving voltage as a driving voltage for driving the selected pixel driving circuit 110*a* in the displaying period. When the constant current is less than the specified value, the controller 80 controls the source driver 30 to increase the pre-driving voltage provided to the selected pixel driving circuit 110*a*.

As described above, the compensating circuit 60*a* controls the driving transistor to be saturated for simulating the pixel driving circuit 110 in the displaying period, and generates a specified parameter for compensating the threshold voltage of the driving transistor and the current of the OLED in one time, thus a difference between the compensated pre-driving voltage related to the threshold voltage and the compensated pre-driving voltage related to the current of the OLED is avoided. The calculating process of the compensating circuit 60*f* is decreased. Further, the difference between the first detecting voltage and the second detecting voltage is calculated in the control module 680 before providing to the latching module 650*d*, the calculating process of the latching module 650*d* becomes simpler. Therefore, the display performance of the display apparatus 1 is improved.

While various embodiments have been described the disclosure is not limited thereto. On the contrary, various modifications and similar arrangements (as would be apparent to those skilled in the art) are also intended to be covered. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A driving control system for driving pixel driving circuits in a display apparatus, the pixel driving circuit sequentially operating during a detecting time period and a displaying period, each pixel driving circuit comprising: a storage capacitor; a driving transistor; and an organic light emitting diode (OLED), and a node defining between a source electrode of the driving transistor and the OLED, the driving control system comprising: a selecting circuit electrically connected to the pixel driving circuits, and configured to select at least one of the pixel driving circuit; a compensating circuit electrically connected with the selected at least one of the pixel driving circuits through the selecting circuit; and a controller; wherein during the detecting time period, the driving transistor in the selected at least one of the pixel driving circuits becomes saturated, and the compensating circuit detects a detecting current of the node in the selected at least one of the pixel driving circuits and obtains a specified parameter based on the detecting current, the controller adjusts a pre-driving voltage provided to the selected at least one of the pixel driving circuits based on the specified parameter detected by the compensating circuit, wherein the specified parameter is a time parameter; the compensating circuit converts the detecting current flowing through the node into a pulse signal, the pulse signal switches between a first level voltage and a second level voltage in turn; the compensating circuit further calculates a sum time of the pulse signal in the first level voltage as the time parameter, and wherein the selecting circuit sequentially selects one of the pixel driving circuits to electrically connected to the compensating circuit; the compensating circuit operates in a first sub-detecting time period and a second sub-detecting time period; during the first sub-detecting time period, the selected pixel driving circuit is driven by a predetermined voltage, the compensating circuit senses a first detecting current, converts into a first pulse signal, and obtains a first time parameter; during the second sub-detecting time period, the selected pixel driving circuit is driven by a pre-driving voltage, the compensating circuit senses a second detecting current, converts a second pulse signal, and obtains into a second time parameter; the controller compares a specified value with a difference between the first time parameter and the second time parameter; when the difference is less than the specified value, the controller increases the pre-driving voltage; when the difference is larger than the specified value, the controller decreases the pre-driving voltage; when the difference is equal to the specified value, the controller stores the pre-driving voltage as the driving voltage of the selected pixel driving circuit.

2. The driving control system of claim 1, wherein during the first sub-detecting time period, the OLED is in a non-illumination state, the first detecting current is a sum of a bias current, a leakage current, and a noise current; during the second sub-detecting time period, the OLED emits invisible light, the second detecting current is a sum of the bias current, the leakage current, the noise current, and a current flowing through the OLED.

3. The driving control system of claim 1, wherein the compensating circuit 5 comprises a first detecting module, a first amplifying module, a latching module, and a calculating module; the first detecting module senses the detecting current and provides the detecting current to the first amplifying module; the first amplifying module amplifies the detecting current in a predetermined ratio to generate an amplified detecting voltage to the latching module; the latching module compares the amplified detecting voltage with a reference voltage to generates the pulse signal; when the amplified detecting voltage is less than or equal to the reference voltage, the pulse signal is in a second level voltage, and when the amplified detecting voltage is larger than the reference voltage, the pulse signal is in the first level voltage.

4. The driving control system of claim 1, wherein the first detecting module further pre-charges the node before sensing the detecting current passing through the node.

5. The driving control system of claim 1, wherein the controller further controls the compensating circuit to be reset when receiving the time parameter.

6. The driving control system of claim 1, wherein the selecting circuit sequentially selects two adjacent pixel driving circuits to electrically connected to the compensating circuit; the compensating circuit is electrically connected to the selected two adjacent pixel driving circuits; one of the selected two adjacent pixel driving circuits is applied with a predetermined voltage as a comparison pixel driving circuit, and the other of the selected two adjacent pixel driving circuits is applied with a pre-driving voltage as a to-be-compensated pixel driving circuit; the compensating circuit senses a first detecting current and a second detecting current from the selected two adjacent pixel driving circuit respectively, and converts a difference between the first detecting current and the second detecting current into a pulse signal, and obtains the time parameter; the controller compares a specified value with the time parameter; when the time parameter is less than the specified value, the controller increases the pre-driving voltage; when the time parameter is larger than the specified value, the controller decreases the pre-driving voltage.

7. The driving control system of claim 1, wherein the compensating circuit 10 comprises a first detecting module, a first amplifying module, a latching module, and a calculating module; the first detecting module senses the first detecting current and the second detecting current and provides the difference between the first detecting current and the second detecting current to the first amplifying module; the first amplifying module amplifies the difference in a predetermined ratio to generate an amplified detecting voltage to the latching module; the latching module compares the amplified detecting voltage with a reference voltage to generates the pulse signal; when the amplified detecting voltage is less than or equal to the reference voltage, the pulse signal is in a second level voltage, and when the amplified detecting voltage is larger than the reference voltage, the pulse signal is in the first level voltage.

8. The driving control system of claim 1, wherein the specified parameter is a voltage parameter, the voltage parameter is linearly varied in accordance with time; the compensating circuit converts the detecting current into a linear voltage as the voltage parameter.

9. The driving control system of claim 8, wherein the selecting circuit sequentially selects one of the pixel driving circuit to electrically connected to the compensating circuit; the compensating circuit operates in a first sub-detecting time period and a second sub-detecting time period; during the first sub-detecting time period, the selected pixel driving circuit is driven by a predetermined voltage, the compensating circuit senses a first detecting current and converts into a first linear voltage, the controller calculates a first constant current based on the first linear voltage; during the second sub-detecting time period, the selected pixel driving circuit is driven by a pre-driving voltage, the compensating circuit senses a second detecting current and converts into a second linear voltage; the controller obtains a second constant current based on the second linear detecting voltage; the controller further compares a specified value with a difference between the first constant current and the second constant current for adjusting the pre-driving voltage.

10. The driving control system of claim 9, wherein when the difference is larger than the specified value, the controller decreases the pre-driving voltage; when the difference is less than the specified value, the controller increases the pre-driving voltage.

11. The driving control system of claim 8, wherein the selecting circuit sequentially selects two adjacent pixel driving circuits to electrically connected to the compensating circuit; one of the selected two adjacent pixel driving circuits is driven by a predetermined voltage as a comparison pixel driving circuit, and the other of the selected two adjacent pixel driving circuits is driven by a pre-driving voltage as a compensated pixel driving circuit; the compensating circuit senses a first detecting current and a second detecting current from the two selected adjacent pixel driving circuit respectively and converts a difference between the first detecting current and the second detecting current into the linear voltage, the controller calculates a constant current based on the linear voltage, and further compares a specified value with the constant current for adjusting the pre-driving voltage; when the constant current is larger than the specified value, the controller decreases the pre-driving voltage; when the constant current is less than the specified value, the controller increases the pre-driving voltage.

12. The driving control system of claim 11, wherein the compensating circuit comprises a first detecting module, a second detecting module, a first amplifying module, a second amplifying module, a latching module, and a calculating module; the first detecting module senses the first detecting current, the first amplifying module amplifies the first detecting current in a predetermined ratio and generates a first amplified detecting current to the latching module; the second detecting module senses the first detecting current, the second amplifying module amplifies the second detecting current in a predetermined ratio and generates a second amplified detecting current to the latching module; the latching module calculates the difference between the first amplified detecting current and the second amplified detecting current, and the calculating module converts the difference into the linear voltage.

13. The driving control system of claim 12, wherein the compensating circuit comprises a first detecting module, a second detecting module, a first amplifying module, a second amplifying module, a control module, a latching module, and a calculating module; the first detecting module senses the first detecting current, the first amplifying module amplifies the first detecting current in a predetermined ratio and generates a first amplified detecting current to the control module; the second detecting module senses the first detecting current, the second amplifying module amplifies the second detecting current in a predetermined ratio and generates a second amplified detecting current to the control module; the control module controls the difference between the first amplified detecting voltage and the second amplified detecting voltage to be provided to the latching module; the latching module latches the difference, and the calculating module converts the difference into the linear voltage.

14. A display apparatus comprising: a plurality of pixel driving circuits; and a selecting circuit electrically connected to the pixel driving circuits, and configured to select at least one of the pixel driving circuits; a compensating circuit electrically connected with the selected at least one of the pixel driving circuits through the selecting circuit; and a controller electrically connected to the compensating circuit; wherein the selected pixel driving circuit sequentially operates during a detecting time period and a displaying period; each pixel driving circuit comprises a storage capacitor, a driving transistor, and a light emitting diode (OLED); a node is defined between a source electrode of the driving transistor and the OLED; during the detecting time period, the driving transistor in the selected at least one of pixel driving circuits becomes saturated, and the compensating circuit detects a detecting current of the node in the at least one of the pixel driving circuits and obtains a specified parameter based on the detecting current, the controller adjusts a driving voltage provided to the selected at least one of the pixel driving circuits based on the specified parameter detected by the compensating circuit wherein the specified parameter is a time parameter; the compensating circuit converts the detecting current into a pulse signal, the pulse signal switches between a first level voltage and a second level voltage in turn; the compensating circuit further calculates a sum time of the pulse signal in the first level voltage as the time parameter, and wherein the selecting circuit sequentially selects one of the pixel driving circuits to electrically connected to the compensating circuit; the compensating circuit operates in a first sub-detecting time period and a second sub-detecting time period; during the first sub-detecting time period, the selected pixel driving circuit is driven by a predetermined voltage, the compensating circuit senses a first detecting current, converts into a first pulse signal, and obtains a first time parameter; during the second sub-detecting time period, the selected pixel driving circuit is driven by a pre-driving voltage, the compensating circuit senses a second detecting current, converts a second pulse signal, and obtains into a second time parameter by; the controller compares a specified value with a difference between the first time parameter and the second time parameter; when the difference is less than the specified value, the controller increases the pre-driving voltage; when the difference is larger than the specified value, the controller decreases the pre-driving voltage; when the difference is equal to the specified value, the controller stores the pre-driving voltage as the driving voltage of the selected pixel driving circuit.

15. The display apparatus of claim 14, wherein during the first sub-detecting time period, the OLED is in a non-illumination state, the first detecting current is a sum of a bias current, a leakage current, and a noise current; during the second sub-detecting time period, the OLED emits invisible light, the second detecting current is a sum of the bias current, the leakage current, the noise current, and a current flowing through the OLED.

16. The display apparatus of claim 14, wherein the first detecting module further pre-charges the node before a sensing operation of the current flowing through the node.

17. The display apparatus of claim 14, wherein the specified parameter is a voltage parameter, the voltage parameter is linearly varied in accordance with time; the compensating circuit converts the detecting current into a linear voltage as the voltage parameter.

18. The display apparatus of claim 17, wherein the selecting circuit sequentially selects one of the pixel driving circuit to electrically connected to the compensating circuit; the compensating circuit operates in a first sub-detecting time period and a second sub-detecting time period; during the first sub-detecting time period, the selected pixel driving circuit is driven by a predetermined voltage, the compensating circuit senses a first detecting current and converts into a first linear voltage, the controller calculates a first constant current based on the first linear voltage; during the second sub-detecting time period, the selected pixel driving circuit is driven by a pre-driving voltage, the compensating circuit senses a second detecting current and converts into a second linear voltage; the controller obtains a second constant current based on the second linear detecting voltage; the controller further compares a specified value with a difference between the first constant current and the second constant current for adjusting the pre-driving voltage.

19. The display apparatus of claim 17, wherein when the difference is larger than the specified value, the controller decreases the pre-driving voltage; when the difference is less than the specified value, the controller increases the pre-driving voltage.

* * * * *